United States Patent [19]

Albertini et al.

[11] Patent Number: 4,651,669

[45] Date of Patent: Mar. 24, 1987

[54] ANCHOR CONSTRUCTION

[75] Inventors: Rocco D. Albertini, Media; Arthur W. McClellan, Aston; Stephen A. Kokoszka, Chester, all of Pa.

[73] Assignee: Baldt Incorporated, Chester, Pa.

[21] Appl. No.: 712,699

[22] Filed: Mar. 18, 1985

[51] Int. Cl.[4] ..... B63B 21/44

[52] U.S. Cl. ..... 114/304; 114/309

[58] Field of Search ..... 114/294, 301–309

[56] References Cited

U.S. PATENT DOCUMENTS

| | | | |
|---|---|---|---|
| D. 127,184 | 5/1941 | Northrop | 114/304 |
| 3,015,299 | 1/1962 | Towne et al. | 114/303 |
| 3,382,835 | 5/1968 | McGuire | 114/308 |
| 3,407,776 | 10/1968 | Newton | 114/309 |
| 3,766,877 | 10/1973 | Beck | 114/309 |
| 3,774,569 | 11/1973 | Linnenbank | 114/309 |
| 3,902,446 | 9/1975 | van der Haak | 114/309 |

FOREIGN PATENT DOCUMENTS

| | | | |
|---|---|---|---|
| 47904 | 4/1979 | U.S.S.R. | 114/304 |

*Primary Examiner*—Trygove M. Blix
*Assistant Examiner*—Thomas J. Brahan
*Attorney, Agent, or Firm*—Cushman, Darby & Cushman

[57] ABSTRACT

A mooring anchor including a pair of spaced part flukes, an integrally cast tripping palm structure integral with said flukes at the rearward end thereof and including a pair of planar, sloping walls diverting rearwardly from the flukes and first and second pairs of transverse reinforcing walls extending transversely between the sloping walls, an elongated solid stock rotatably received through aligned openings in the reinforcing walls and through the rearward end of a rigid elongated shank having a clevis receiving apertured lug portion at its forward end. The sloping walls of the tripping palm have apertures extending therethrough at positions rearwardly of each surface of each fluke and between the adjacent associated reinforcing walls. The shank has a rearward cross-section transition zone at a position forwardly adjacent the connection thereof with the stock, a forward cross-section transition zone at a position rearwardly of the forward lug portion and a central cross-section transition zone between the forward and rearward zones. The shank has a cross-sectional configuration shaped as a rectangle between the rearward transition zone and the central transition zone and a cross-sectional configuration shaped as a diamond between the central transition zone and the forward transition zone.

12 Claims, 8 Drawing Figures

60
8
8
38
7
7
24
24
12
12
58
10
6
6
5
5
56
40
40
48
18
36
46
20
52
28
30
54
22
14

ANCHOR CONSTRUCTION

This invention relates to anchors and more particularly to improvements in anchors of the type described in U.S. Pat. No. 3,774,569.

The anchor described in the above noted patent includes a pair of flat flukes rigidly connected in side-by-side relation by a tripping palm structure formed integrally with the rear ends of the flukes. The tripping palm structure includes rearwardly diverging walls reinforced by spaced end walls. A stock extends transversely through the end walls of the tripping palm structure and pivotally supports a centrally located forwardly extending shank. While the anchor of the patent has given good performance in actual operation, there is always a need to improve the quality and performance of a product in such a way as not to materially add to its cost so that the product becomes more cost effective.

It is an object of the present invention to be responsive to such a need. In accordance with the principles of the present invention this objective is realized by providing in the rearwardly diverging walls of the tripping palm structure a plurality of apertures at positions rearwardly of each surface of each fluke and between adjacent associated reinforcing walls of the tripping palm structure. These apertures serve to facilitate initial penetration, enhance the holding power and to aid in the breaking out of the anchor.

In accordance with the principles of the present invention, the above noted objective is also obtained by modifying the cross-sectional configuration of the anchor shank so as to provide the shank with a rearward cross-sectional configuration transition zone at a position forwardly adjacent the connection thereof with the stock, a forward cross-sectional configuration transition zone at a position rearwardly of the forward lug portion and a central cross-sectional configuration transition zone between the forward and rearward zones. The shank is formed with a cross-sectional configuration shaped as a rectangle between the rearward transition zone and the central transition zone and a cross-sectional configuration shaped as a diamond between the central transition zone and the forward transition zone. These configurations aid rapid penetration and enhance racking.

These and other objects of the present invention will become more apparent during the course of the following detailed description and appended claims.

The invention may be best understood by reference to the accompanying drawings wherein illustrative embodiments are shown.

Figure 1:
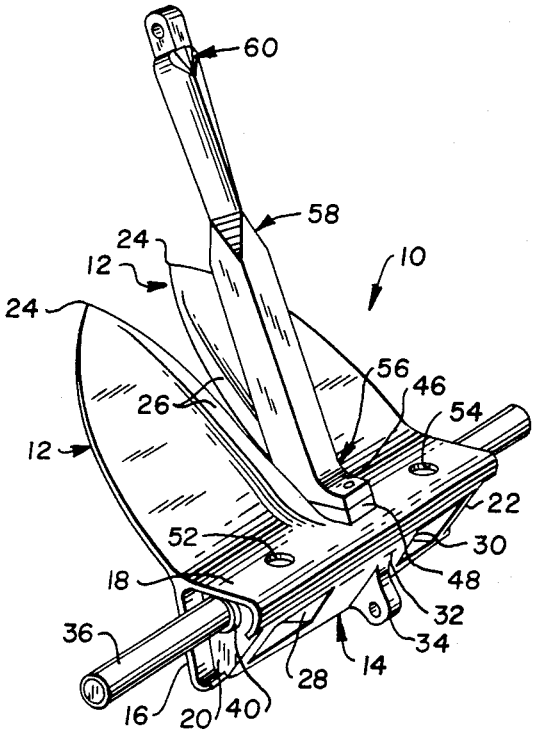
FIG. 1 is a perspective view of the anchor showing the flukes in one of their limiting positions.
Figure 4:
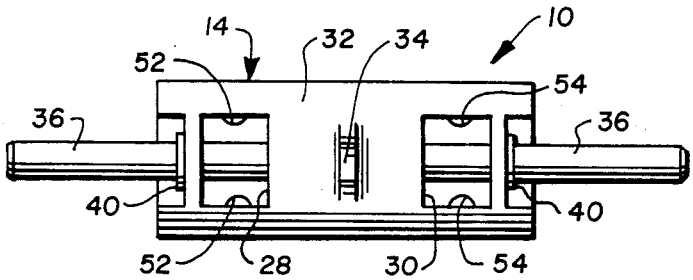
FIG. 4 is a reduced bottom view of the anchor in the position shown in FIGS. 2 and 3.
Figure 2:
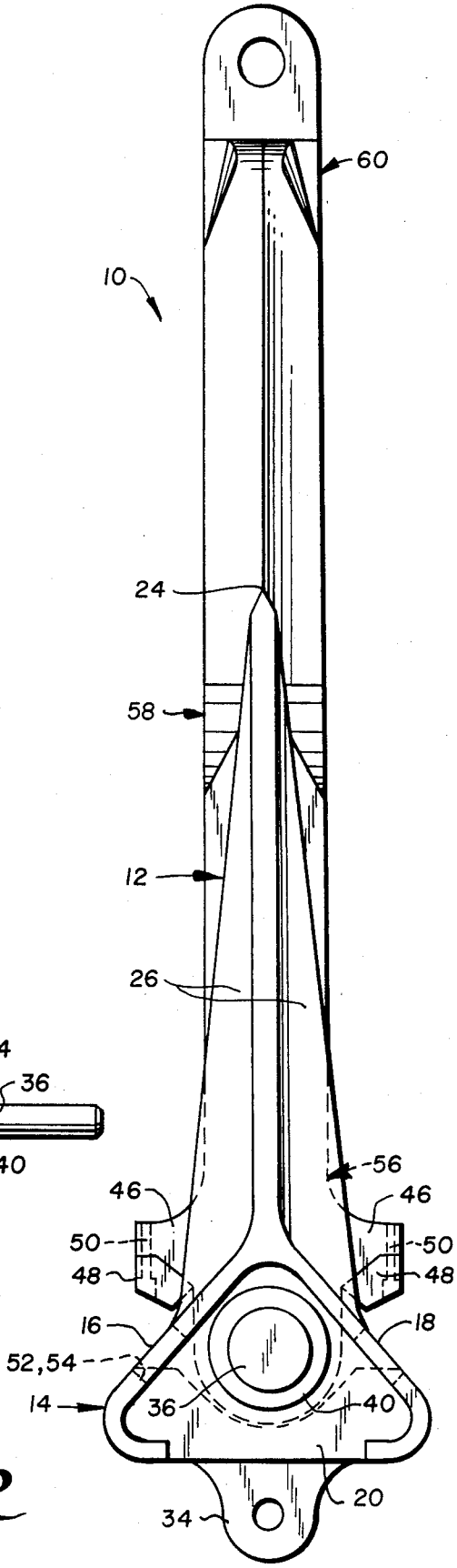
FIG. 2 is an enlarged end view of the anchor showing the flukes in a central position intermediate the two limiting positions thereof, both the left hand end view and the right hand end view being identical.
Figures 3, 5, 6, 7, 8:
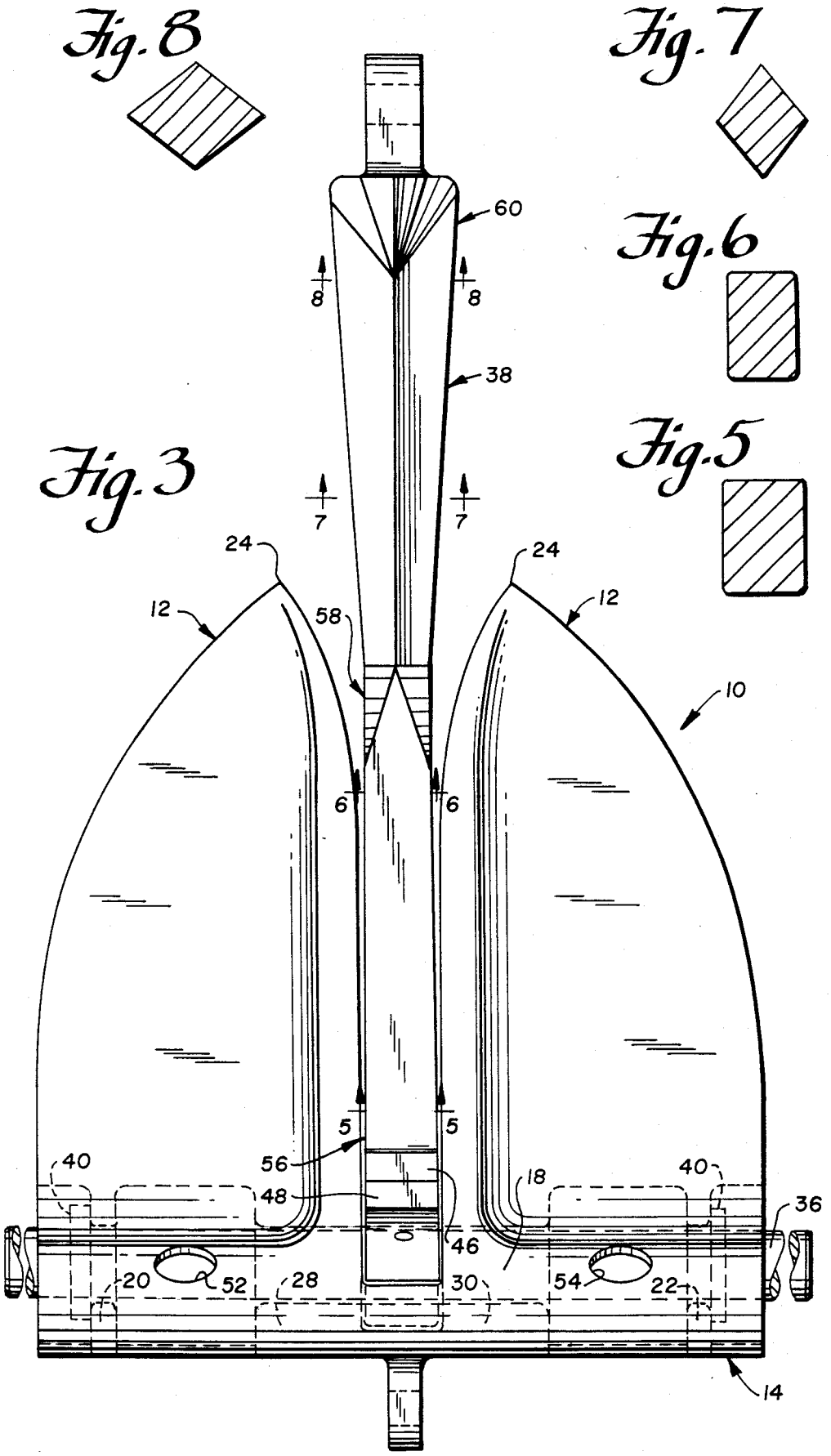
FIG. 3 is a front elevational view of the anchor in the position shown in FIG. 2, the rear elevational view being the same as the front elevational view.

FIGS. 5 thru 8 are cross-sectional views taken along the lines 5—5 thru 8—8 of FIG. 3.

Referring now more particularly to the drawings, there is shown therein an anchor, generally indicated at 10, embodying the principles of the present invention. The anchor 10 includes twin flat parallel flukes, generally indicated at 12, having a tripping palm structure, generally indicated at 14, at the rearward end thereof. The tripping palm structure 14 extends tranversely of the flukes 12 and joins the flukes together. The palm 14 includes walls or faces 16 and 18 which slope upwardly and outwardly from the plane of the flukes 12 at an angle of approximately 40° with respect to the plane of the flukes 12. The palm 14 also includes opposite end walls 20 and 22. Each of the flukes 12 includes a forward point 24 and a stiffening web 26 which extends along the inner edge of each fluke 12 to abut spaced side walls 28 and 30 which also serve to support the palm walls 16 and 18. Side walls 28 and 30 are joined by a central bottom wall 32 so as to provide added strength to the tripping palm. An eye 34 is provided on wall 32 for attachment of a line or cable to be used in marking the position of the anchor and to be used in retrieval of the anchor by application of a lifting force to the palm end of the anchor.

The sloping palm wall which is engaged with the bottom serves to rotate the tripping palm structure 14 and the attached flukes 12 on a stock 36 whereby the points 24 of the flukes 12 dig into the bottom. Under continued pull on a shank, generally indicated at 38, the flukes 12 assume a limiting position on the stock 36 and thereafter, the anchor digs into the bottom until it is completely buried.

The stock 36, as shown, is in the form of a shaft and extends through the tripping palm structure 14 and is held in place by keeper rings 40 welded to the stock to maintain it in position. The stock 36 also provides a pivotal support for the shank 38 which extends forwardly from the stock to its forward end 42 upon which is mounted a shackle (not shown) which serves to connect the anchor chain to the anchor 10.

The shank 38 is formed at its rearward end portion with an outwardly extending abutment 46 on each side thereof which is adapted to engage a palm wall and so limit the movement of the shank 38 with respect to the flukes 12 and the tripping palm structure 14 integral therewith. In that form of structure shown, the shank 38 can be moved to an angle of about 50° in either direction from the plane of the flukes to provide an anchor which is extremely efficient in soft mud. Each abutment 46 is formed to receive an adapter 48 which is secured in place by bolts 50 and which serves to limit the movement of the shank 38 with respect to the flukes 12 and tripping palm structure 14 to an angle of about 28° which the anchor is most efficient in sand.

The structure thus far described is extremely rugged. Further, even though it has been used as a mooring for a considerable period and has become substantially permanently embedded in bottom, it is nevertheless sufficiently rugged that it can withstand the removal forces essential to its retrieval from bottom.

In accordance with the principles of the present invention, in order to facilitate initial penetration, enhance the holding power and to aid in the breaking out of the anchor, the sloping palm walls 14 and 16 are formed with pairs of through openings 52 and 54 disposed in positions rearwardly of both flat surfaces of both flukes 12. A pair of openings 52 on one side of the tripping palm structure 14 is positioned centrally between the associated pair of side walls 20 and 28 while the pair of openings 54 on the other side is positioned centrally between the associated pair of side walls 22 and 30.

In accordance with the principles of the present invention, the shank 38 is given a cross sectional configuration which both aids in rapid penetration and enhances racking. As shown, the shank includes a longitudinal axis and is symetrical about a first plane passing through the longitudinal axis and the axis of the stock 36 and a second plane perpendicular to the first plane passing through the longitudinal axis. The shank 38 includes a rearward transition zone forwardly of the abutments 46, a central transition zone 56 and a forward transition zone 60 rearwardly of a forward clevis receiving apertured lug portion 62. At a position forwardly of the rearward transition zone, the shank 38 is formed with a rectangular cross-sectional configuration. While the relative dimensions may vary, as shown, the ratio of the dimension in the first plane to the dimension in the second plane is approximately 0.625 to 1, as shown in FIG. 5.

From the forward end of the rearward transition zone 56, the rectangular cross-section tapers to a slightly smaller rectangular cross-section at the rearward end of the central transition zone 58. At the rearward end of the central transition zone 58 the first plane dimension to the second plane dimension ratio is approximately 0.706 to 1, as shown in FIG. 6.

At the forward end of the central transition zone 58, the rectangular cross-section becomes a rhombus (diamond) oriented with one pair of opposed corners within the first plane and the other pair of corners in the second plane. The first plane dimension to second plane dimension ratio is also approximately 0.706 to 1, as shown in FIG. 7.

The diamond cross-section tapers forwardly from the forward end of the central transition zone 58 to a square and then to an oppositely oriented diamond at the rearward end of the forward transition zone 60 where the corner to corner dimension measured in the first plane has decreased slightly while the other corner to corner dimension measured in the second plane has increased to a greater extent. The final first plane dimension to second dimension ratio is approximately 1.27 to 1, as shown in FIG. 8.

It thus will be seen that the objects and advantages of this invention have been fully and effectively achieved. It will be realized, however, that the foregoing specific embodiments have been disclosed only for the purpose of illustrating the principles of this invention and are susceptible of modification without departing from such principles. Accordingly, the invention includes all embodiments encompassed within the spirit and scope of the following claims.

What is claimed is:

1. In a mooring anchor including a pair of spaced apart flukes having forward ends and rearward ends, said flukes having elongated reinforcing webs along adjacent side edges thereof, an integrally cast tripping palm structure integral with said flukes at the rearward end thereof and including a pair of planar, sloping walls diverting rearwardly from the flukes, a first pair of tranverse reinforcing walls extending transversely between said sloping walls adjacent the opposite ends thereof, a second pair of spaced apart transverse reinforcing walls extending transversely between said sloping walls in general alignment with the reinforcing webs on the flukes, aligned openings through said reinforcing walls, an elongated solid stock rotatably received through said aligned openings and projecting at its opposite ends substantially beyond the opposite ends of the tripping palm structure, a rigid elongated shank pivotally mounted at one end thereof on said stock between said second pair of reinforcing walls and extending between said flukes and having a clevis receiving apertured lug portion at its forward end, the improvement which comprises:

said shank having a rearward cross-sectional configuration transition zone at a position forwardly adjacent the connection thereof with said stock, a forward cross-sectional configuration transition zone at a position rearwardly of said forward lug portion and a central cross-sectional configuration transition zone disposed generally equidistantly between said forward and rearward zones, said shank having a cross-sectional configuration shaped as a rectangle between said rearward transition zone and said central transition zone and a cross-sectional configuration shaped as a diamond between said central transition zone and said forward transition zone.

2. The improvement as defined in claim 1 wherein said sloping walls have apertures extending therethrough at positions rearwardly of each surface of each fluke and between the adjacent associated reinforcing walls of said first and second pairs.

3. The improvement as defined in claim 1 wherein said shank includes a longitudinal axis and is symetrical about (1) a first plane passing through said longitudinal axis and the axis of said stock and (2) a second plane passing through said longitudinal axis which is perpendicular to said first plane.

4. The improvement as defined in claim 3 wherein the dimension of said rectangular cross-sectional configuration measured in said first plane is less than the dimension measured in said second plane.

5. The improvement as defined in claim 4 wherein the dimensions of said rectangular cross-sectional configuration measured in both planes decrease slightly in a forward direction.

6. The improvement as defined in claim 5 wherein the corner-to-corner dimension of said diamond cross-sectional configuration measured in the first plane with respect to the corner-to-corner dimension measured in said second plane is less adjacent said central transition zone and more adjacent said forward transition zone.

7. The improvement as defined in claim 6 wherein the corner-to-corner dimension of said diamond cross-sectional configuration measured in the first plane decreases slightly in a forward direction.

8. The improvement as defined in claim 7 wherein the corner-to-corner dimension of said diamond cross-sectional configuration measured in said second plane increases in a forward direction.

9. The improvement as defined in claim 3 wherein the dimensions of said rectangular cross-sectional configuration measured in both planes decrease slightly in a forward direction.

10. The improvement as defined in claim 3 wherein the corner-to-corner dimension of said diamond cross-sectional configuration measured in the first plane with respect to the corner-to-corner dimension measured in said second plane is less adjacent said central transition zone and more adjacent said forward transition zone.

11. The improvement as defined in claim 10 wherein the corner-to-corner dimension of said diamond cross-sectional configuration measured in the first plane decreases slightly in a forward direction.

12. The improvement as defined in claim 11 wherein the corner-to-corner dimension of said diamond cross-sectional configuration measured in said second plane increases in a forward direction.

* * * * *